US006948573B2

(12) United States Patent
China et al.

(10) Patent No.: US 6,948,573 B2
(45) Date of Patent: Sep. 27, 2005

(54) ROCK BREAKER TOOL

(76) Inventors: Ferruccio I. China, 90 Grand Blvd., Sault Ste. Marie, Ontario (CA), P6B 4S1; Carlo B. China, 57 Woodhurst Drive, Sault Ste. Marie, Ontario (CA), P6C 5Z5

( * ) Notice: Subject to any disclaimer, the term of this patent is extended or adjusted under 35 U.S.C. 154(b) by 0 days.

(21) Appl. No.: 10/690,678

(22) Filed: Oct. 22, 2003

(65) Prior Publication Data

US 2005/0088033 A1 Apr. 28, 2005

(30) Foreign Application Priority Data

Oct. 22, 2003 (CA) ..... 2409464

(51) Int. Cl.[7] ..... E21C 37/02
(52) U.S. Cl. ..... 175/269; 299/22; 299/23
(58) Field of Search ..... 299/20–23; 175/267, 175/230, 269; 173/202, 204, 121, 135

(56) References Cited

U.S. PATENT DOCUMENTS

| | | | | |
|---|---|---|---|---|
| 1,514,058 A | * | 11/1924 | Linnemann | 299/23 |
| 3,425,500 A | * | 2/1969 | Fuchs | 175/269 |
| 4,039,033 A | | 8/1977 | Salmi | 173/105 |
| 4,690,460 A | | 9/1987 | Lebedev | 299/21 |
| 4,858,701 A | | 8/1989 | Weyer | 173/50 |
| 5,000,517 A | | 3/1991 | Lebedev | 299/21 |
| 5,775,848 A | | 7/1998 | Blankinship et al. | 405/244 |

FOREIGN PATENT DOCUMENTS

| | | | |
|---|---|---|---|
| JP | 4-9397 | * | 2/1992 |
| WO | 0305552 | * | 3/1987 |
| WO | 0305553 | * | 3/1987 |
| WO | 0306539 | * | 3/1987 |

* cited by examiner

*Primary Examiner*—Sunil Singh
(74) *Attorney, Agent, or Firm*—Welsh & Katz, Ltd.; Thomas R. Vigil

(57) ABSTRACT

The device for breaking rocks includes a hollow cylindrical chamber having a closed lower end, a closed upper end and an access aperture in the closed upper end and an outer circumstantial surface. A cylindrical plunger is longitudinally-reciprocally disposed within the interior of the cylindrical chamber, has a converging portion and is biased to a retracted position. Four spools are equally disposed around the circumference of the cylindrical plunger, each spool including a converging upper end which is configured to be in slidable contact with the converging portion of the cylindrical plunger. Four hardened inserts are secured to an outer face of an associated spool. Each spool and secured hardened insert is biased to an inner retracted position. Hydraulic pressure is applied to the upper face of the cylindrical plunger to urge the converging portion to move downwardly, thereby urging the spools, together with the secured hardened inserts, radially-outwardly so that the hardened inserts project radially outwardly from the outer surface of the hollow cylindrical chamber whereby the radially-outwardly-projecting inserts can fracture a rock face.

15 Claims, 4 Drawing Sheets

ROCK BREAKER TOOL

FIELD OF THE INVENTION

This invention relates to a hydraulically-operated striking apparatus. More particularly, this invention relates to an apparatus for breaking rocks, which apparatus is operated by hydraulic pressure.

BACKGROUND OF THE INVENTION

Currently, rock quarries use a series of cored holes in rock faces and fill them with explosives. When these explosives are discharged, the flying debris becomes very dangerous and most of the time leaves the rock in large pieces, which must be exploded again into smaller, manageable pieces to be crushed The explosives are an expensive one-time use and are very hazardous to handle and ship. Furthermore, explosives are banned in areas, such as city limits, and in some areas of mines.

To overcome such problems, various rock drills have been suggested which are operated by pressure liquid One such prior art rock drill comprises a body to which a tool can be attached. The body includes a striking piston moving to and fro in a cylinder space, and a distributing valve located in a distributing tool. The piston and the distributing valve are operated by pressure liquid. The object of the distributing valve is to accomplish the motion of the piston to and fro. Because they avoid the use of explosives, such hydraulic splitters are now widely used in the mining industry.

However, the fact that the drive of a hydraulic splitter is located outside a borehole results in an increase in weight of the hydraulic splitter due to the need to increase thickness of walls of the hydraulic splitter upon an increase in pressure in its hydraulic system. This also substantially limits the field of application of hydraulic splitters. Maximum splitting force as the directional propagation of a fracture is only possible in the immediate vicinity to the working member. A concentration of load at the mouth of the borehole may cause surface spalling of a block rather than the formation of a predetermined splitting plane.

Also known in the art is a powered member having an axially-parting casing accommodating a coaxially-mounted flexible tubular chamber and a pair of spacer inserts, each located on the casing parting line side. The powered member has a pair of rings, each having a nipple designed for supplying fluid to the interior of the flexible chamber. Each end of the flexible chamber is disposed between the nipple and ring. A perforated tubular core is provided to extend in the interior of the flexible chamber along the longitudinal axis thereof. Each end of the core is made in the form of a nipple. Each ring is in the form of a bushing having an inner thread coupled to an outer thread of the nipple. The rings are thus rigidly secured to each other by means of the tubular core. The rings are designed for sealing the ends of the flexible chamber. When fluid under pressure is supplied to the interior space of the flexible chamber, the parts of the casing are tensioned under the action of both flexible chamber and spacer inserts.

Still further known in the art is a power unit comprising a housing, internally accommodating along its longitudinal axis and throughout its entire length, a tubular elastic vessel with sealing means disposed at the ends thereof. The housing of the power unit comprises two portions, one of which is stationary relative to the axis of the power unit, while the other one is an extendable metal plunger. When pressure in the hydraulic system is raised, the inner space of the elastic vessel is filled with a working medium and the vessel is expanded As the volume occupied by the elastic vessel is restricted by the housing portions, the plunger extends and acts upon an object. The power unit develops the force in a direction which is proportionally to the area of the plunger surface in contact with the elastic vessel.

Yet another device known in the prior art is a power unit which comprises a longitudinally-split housing internally coaxially accommodating a tubular elastic vessel and two expanding inserts, each of which is disposed on the side of the parting line of the housing. In addition, the power unit incorporates two holders, each of which is provided with a pipe union intended for delivery of a working medium into the space of the elastic vessel. Each of the ends of the elastic vessel is disposed between the pipe union and the holder. A perforated tubular core is arranged in the space of the elastic vessel along the longitudinal axis thereof. Each end of the perforated tubular core is made in the form of a pipe union. Each of the holders is essentially a sleeve with the internal thread engaged with the external thread of the pipe union. Thus the holders are rigidly connected with each other through the medium of the perforated core. The holders are intended for sealing the ends of the elastic vessel. When the working medium is delivered under pressure into the inter space of the elastic vessel, the housing portions are expanded, thus expanding both the elastic vessel and the expanding inserts.

Such known power units have failed to find wide application in breaking natural rock monoliths, for example, granite, off the rock mass because of a limited force developed by the elastic vessel, as the power unit cannot develop the required force in a preset direction, i.e., in a direction which is perpendicular to the plane of the break. The material of the elastic vessel "flows" in this clearance and then the vessel ruptures. The core stretching weakens the sealing of the elastic vessel ends which brings about leaks of the working medium. It has been suggested to reduce the stretching of the core by increasing the core cross-sectional area. However, this leads to a sharp increase in the overall dimensions and metal content of the power unit. If the original overall dimensions of the power unit were to be maintained, a decrease is brought about in the working travel of the movable portions of the housing and a rise of the unit pressure at the place where the side surface of the inserts come in contact with the inner surface of the housing. This is not desirable, since it involves the use of special materials and lubricants.

Accordingly, many patents have been provided which have attempted to solve such problems. Among these patents are:

U.S. Pat. No. 4,039,033, patented Aug. 2, 1977, by P. N. Salmi, which provided a striking apparatus comprising a body to which the tool can be movably attached. The body included a striking piston moving to and fro in the cylinder space and a liner type distributing valve concentric with the piston, moving to and fro in the valve space and aimed for changing the direction of the motion of the piston. Pressure liquid from an annular space defined by the body of the drill, the piston and the distributing valve, was used to operate a hydraulic rotating motor.

U.S. Pat. No. 4,858,701, patented Aug. 22, 1989, by P. P. Weyer, which provided a percussion device for breaking apart or forming cuts or holes in a stationary work piece, e.g., a rock, cement or other hard material. The device included a fluid-powered rotary actuator with an outer body having a forward end and a rearward end, and having ports for the introduction of pressurized fluid within the body. A drive member extended within the body and was supported for rotation relative thereto within a limited rotational range. The drive member had an interior bore extending fully and generally coaxially through the drive member from a forward drive member end to a rearward drive member end. The drive member bore was sized to include the tool shank therewithin in generally coaxial arrangement with the drive member. The drive member bore had drive means for transmitting selective rotational drive force from the drive member to the tool as the drive member was selectively rotated within the limited rotational range. The drive means also restrained the tool against rotation when the drive member was held stationary by the application of fluid within the body through the ports. The drive means permitted substantially unrestricted axial movement of the tool relative to the drive member within a limited longitudinal range. The drive member held the tool working head positioned at the forward body end exterior of the body to engage the work piece and the rearward end portion of the tool positioned at the rearward end of the body. The drive member included lock means at the forward drive member end for locking the tool against forward removal from the drive member bore while permitting substantially-unrestricted reciprocal axial movement of the tool within the limited longitudinal range. The tool was movable axially within the limited longitudinal range to a position where the rearward end portion of the tool was axially endwise impacted by the striker of a percussion hammer which was moveable with reciprocating motion to provide repeated endwise impact to the tool. The striker drove the tool forwardly when the working head of the tool was moved into engagement with the work piece.

U.S. Pat. No. 4,690,460, patented Sep. 1, 1987, by J. A. Lebedev, which provided a power unit comprising a longitudinally-split housing internally coaxially accommodating a tubular elastic vessel. The housing included two expanding inserts, each of which was disposed on the side of the housing parting line the base of which was against the elastic vessel, while the sides were against the inner wall of the housing. The housing included two holders which were such provided with a pipe union for delivery of a working medium into the space of the elastic vessel. Each of the ends of the elastic vessel was disposed between the pipe union and the holder. Each of the holders had a flange disposed in a circular recess which was made on the inner surface of the housing and accommodated an elastic element surrounding the tubular elastic vessel. The pipe unions were installed in the holders for longitudinal movement.

U.S. Pat. No. 5,000,517, patented Mar. 19, 1991, by J. A. Lebedev, which provided a powered member comprising an axially-parting casing accommodating a coaxially mounted flexible tubular chamber. The casing included spacer inserts, each being located on the side of the parting plane of the casing and in a plane which was perpendicular with respect to the axis of the casing. The spacer inserts had a base bearing against the flexible chamber and the sides bearing against the inner surface of the casing wall. The casing included a pair of nipples for supplying fluid to the interior of the flexible chamber and for air escape therefrom provided on the side of the end faces of the casing for movement along the longitudinal axis of the casing, and a means for attaching each end of the flexible tubular chamber to a nipple head. The means for attaching each end of the flexible chamber to the nipple head included a pair of cylindrical bushings interconnected by means of a tenon and a mortise joint, received in the casing and defining a central passage having its axis aligned with the axis of the casing. The walls of the passage in a plane drawn in parallel with the longitudinal axis of the casing had the configuration of two truncated cones having their larger bases facing towards each other. One generatrix of the conical surface of the passage extended substantially in parallel with the generatrix of one conical surface of the nipple head. The other generatrix of the passage extended substantially in parallel with another generatrix of the conical surface of the nipple head.

The above-described tools were somewhat similar, in their physical construction, to devices for anchoring earth and rock. Such anchoring devices were frequently employed for anchoring gas and petroleum-product pipelines, guy-supported towers, utility poles, large-sized retaining walls and building foundations, among numerous other types of application.

One type of such anchoring device included an expanding rock anchor in which an essentially-cylindrical structure included radially-outwardly expandable wedges which was adapted to be inserted into a hole drilled into rock or rock formations, and then expanded by means of a suitable turning rod and screw structure, thereby causing the wedge surfaces to expand radially and grippingly engage the wall of the drilled hole. A guy wire could then be secured to the upper end of the rod which was utilized for expanding the wedges of the rock anchor, so as to form a guying structure for securing line poles or other types of structures.

Another type was represented by U.S. Pat. No. 5,775,848, patented Jul. 7, 1990, by W. J. Blankinship et al, which provided an expanding earth anchor including the expandable wedge-like blades supporting on a base The encasing of the anchor components was through the intermediary of a plastic shrink wrap film to retain them in their initial assembled condition prior to installation in the earth. The covering of the components with a tightly encasing packaging material was said to maintain the components, i.e., the base and the expandable wedge-like blade portion. Moreover, the tight interconnection between the base and the wedge-like expandable anchoring element was said to prevent the previously-encountered wobbling between these components during installation into a bore hole, thereby rendering easier the insertion into the bore hole.

However, it is noted that none of the prior art rock splitters provided a breaking action which was in the form of a gentle burst without flying debris and loud exploding noises.

It is therefore an object of a first aspect of the present invention to provide an improved rock splitter in which the means for transmitting the forces to expand the radially-outwardly expandable portions of the housing is improved.

An object of a second aspect of the present invention is to provide such a rock splitter in which the radially-outwardly expendable portions are more uniformly and accurately radially-outwardly expanded.

An object of a third aspect of the present invention is to provide such a rock splitter which provides superior work performance.

An object of a fourth aspect of the invention is to provide such a rock splitter in which the rush of flying debris during use is obviated.

One broad aspect of the present invention provides a device for breaking rocks comprising a hollow cylindrical chamber having a closed lower end, a closed upper end and an access aperture in the closed upper end and an outer circumferential surface. A cylindrical plunger was longitudinally-reciprocally-disposed within the interior of the cylindrical chamber, the plunger being biased to a retracted position, the upper end of the plunger having an upper face and a converging, preferably frusto-conical, portion below the upper face. At least two, preferably four, spools are disposed equally around the circumference of the cylindrical plunger. Each spool includes a converging upper end, preferably frusto-conical, which is configured to be in slidable contact with the converging, preferably frusto-conical, portion of the cylindrical plunger. Each spool preferably included an outer, curved, longitudinally-extending, partial circumferential surface, and an inner, curved, longitudinally-extending, partial circumferential surface. A like, at least two, preferably four, hardened inserts, are secured to an outer face of an associated spool. Each hardened insert has a partial, circumferential, outer surface, which is coextensive with the outer circumferential surface of the cylindrical chamber. Each spool and secured insert is biased to an inner retracted position. Means are provided for applying a hydraulic pressure to the upper face of the cylindrical plunger. In this manner, the converging portion of the cylindrical plunger is urged to move downwardly, thereby urging the spools, together with the secured hardened inserts, radially-outwardly so that the hardened inserts project radially outwardly from the outer surface of the hollow cylindrical chamber. Thus, when the device is disposed within a bore of the rock to be broken, the expanded inserts fracture the rock.

By one feature of such device, at least two, and preferably four, equalizers are equally disposed around the plunger, and rest on the inner face of the closed lower end. Each equalizer includes an upper, diverging, preferably frusto-conical, face, the lower end of each at least two, preferably four, spools includes a diverging, preferably frusto-conical, face which is configured to be in slidable contact with an associated upper diverging, frusto-conical face of an associated spool. By a preferred feature thereof, each equalizer includes an inner diverging, preferably frusto-conical, face, and the cylindrical plunger includes a lower pointed, preferably conical, end in slidable contact with the inner diverging faces.

By other features of such device, the cylindrical plunger is biased to its retracted portion by a longitudinally-positioned compression spring.

By still other features of such device, each spool is biased to the inner retracted position by means of radially-positioned compression springs, and preferably, an upper compression spring and a lower compression spring.

By still further features of such device, the cylindrical plunger includes an upper threaded cylindrical portion, an adjacent, integral, cylindrical portion of greater diameter than the upper threaded cylindrical portion, an adjacent, integral, frusto-conical portion, an adjacent, integral, depending cylindrical portion whose diameter is less than the diameter of the upper cylindrical portion, and a lowest integral adjacent conical point.

By yet still further features of such device, each spool includes an outer, curved, longitudinally-extending, partial circumferential surface, and an inner, curved, longitudinally-extending, partial circumferential surface, an upper converging partial frusto-conical surface between the outer, curved, longitudinally-extending, partial circumferential surface and the inner curved longitudinally-extending partial circumferential surface, a lower diverging, partial frusto-conical surface between the inner, curved, longitudinally-extending, partial circumferential surface, and the outer, curved, longitudinally-extending partial circumferential surface, and a terminal, partial circumferential flange.

A preferred embodiment of the present invention provides a device for breaking rocks comprising an upper hollow cylindrical chamber (A) which is connected to a lower cylindrical chamber (B). The upper hollow cylindrical chamber (A) includes a closed upper end, the closed upper end including an access aperture, an upper and a lower support ring. The lower support ring includes an upstanding cylindrical rod and a lower, internally-threaded bushing. A compression spring surrounds the upstanding cylindrical rod, the upper end of the compression spring abutting the lower surface of the upper support ring, and the lower end of the compression spring resting on the upper surface of the lower support ring. The lower cylindrical chamber (B) comprises an open upper end and a closed lower end. A concentrically-disposed cylindrical plunger is contained within the lower hollow cylindrical chamber (B). The cylindrical plunger includes an upper, threaded, cylindrical portion threadedly secured to the lower, internally-threaded bushing of the lower support ring, an adjacent, integral cylindrical portion of greater diameter than the upper, threaded, cylindrical portion, an adjacent integral frusto-conical portion an adjacent, integral, depending cylindrical portion whose diameter is less than the diameter of the upper cylindrical portion, and a lowest integral adjacent conical point. Four spools are disposed equally circumferentially around the cylindrical plunger. Each spool includes an outer, curved, longitudinally-extending, partial circumferential surface, and an inner, curved, longitudinally-extending, partial circumferential surface. An upper converging, partial frusto-conical surface is provided between the outer, curved, longitudinally-extending partial circumferential surface and the inner curved longitudinally-extending partial circumferential surface. A lower, diverging, partial frusto-conical surface is provided between the inner, curved, longitudinally-extending partial circumferential surface and the outer curved longitudinally-extending partial circumferential surface. A terminal partial circumferential flange is also provided. The partial frusto-conical upper end of each spool is configured to be in slidable contact with an associated frusto-conical portion of the cylindrical plunger. Each spool is biased to an inner retracted position. Four hardened inserts are provided. Each hardened insert is secured to an outer face at an associated spool. Each hardened insert includes an elongated sliver of a cylinder having an outer curved face and an inner flat face, the inner flat face is secured to the outer face of an associated spool by means of longitudinally spaced-apart removable securing means. Each spool and its secured insert is biased to the inner retracted position by means of two longitudinally-spaced-apart, compression springs. One end of each compression spring is anchored within a radial well in an associated spool, and is secured by means of removable securing means to the outer circumference of the lower hollow cylindrical chamber. Four equalizers are disposed equally around the circumference of the cylindrical plunger and rest on the inner face of the lower closed end of the lower cylindrical chamber. Each equalizer includes an inner diverging, partial frusto-conical face, which is configured to be in slidable contact with the lower pointed conical point of the cylindrical plunger. Each equalizer includes an outer, diverging, partial frusto-conical face, and a lower partially-cylindrical portion. The outer diverging partial frusto-conical portion is configured to be in sliding contact with the lower, diverging, partial frusto-conical portion of an associated spool. The outer, partial cylindrical portion of the equalizer is configured to be in slidable contact with the partial cylindrical flange of an associated spool. The device further includes (C) means for applying hydraulic pressure to the upper face of the cylindrical plunger. In this way, the converging portion of the cylindrical plunger is urged to move downwardly, thereby urging the spools, together with the secured hardened inserts, radially-outwardly, so that the hardened inserts project radially-outwardly from the outer surface of the hollow cylindrical chamber.

By one feature of this preferred embodiment, the upper hollow cylindrical chamber (A) is further connected to the lower hollow cylindrical chamber (B) by means of cooperating cylindrical portions of lesser diameter on one of the hollow cylindrical chamber, (A) or (B) and flange portions of greater diameter on the other of the hollow cylindrical chamber, (B) or (A), respectively.

BRIEF DESCRIPTION OF THE DRAWINGS

Embodiments of the present invention will now be described, by way of example only, with reference to the attached Figures, wherein.

DETAILED DESCRIPTION OF THE INVENTION

Figure 1:
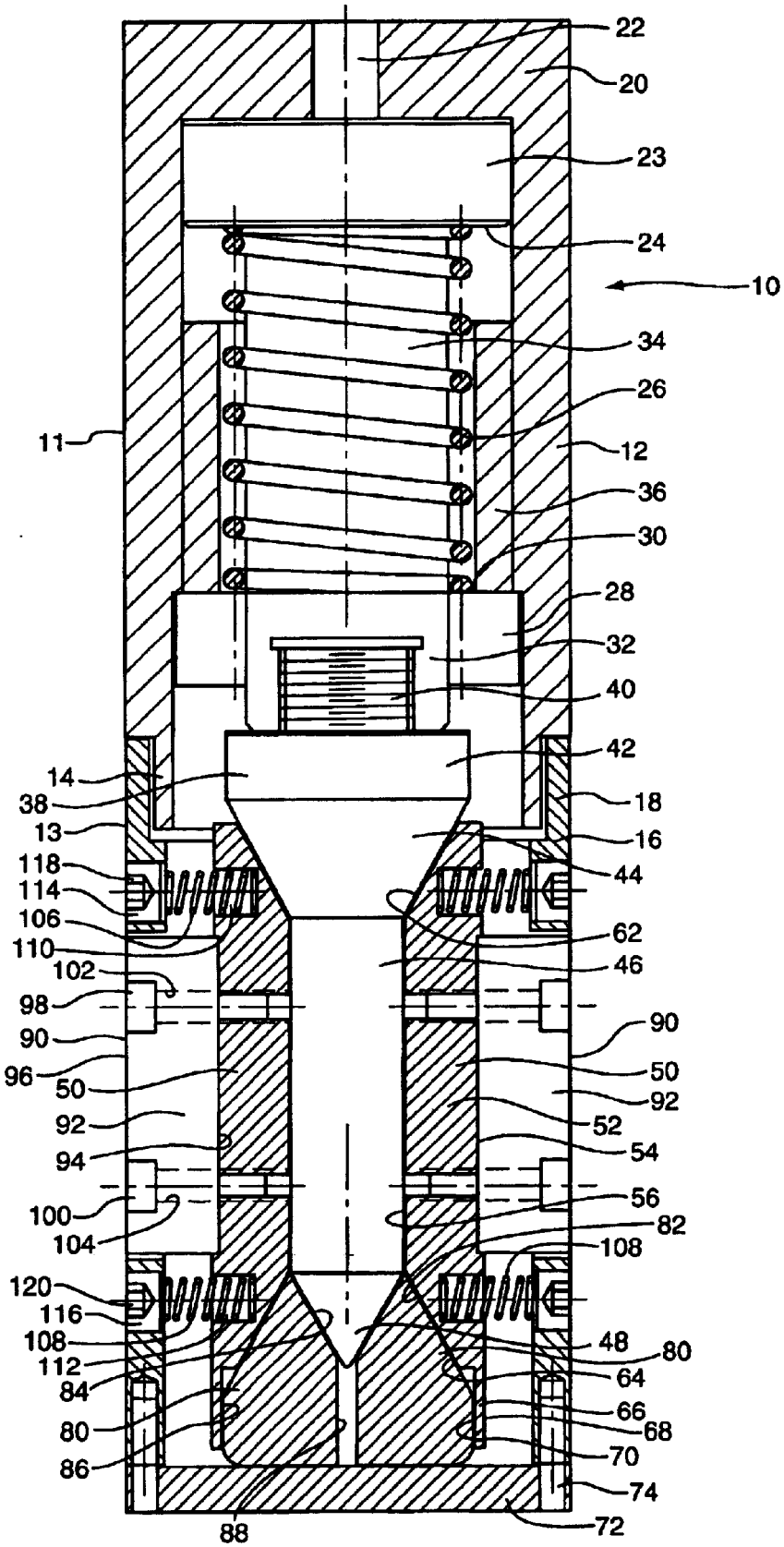
FIG. 1 is a longitudinal cross-section of one embodiment of a rock breaker tool according to one aspect of the present invention.

As seen in FIGS. 1 to 5, the rock breaker tool 10 of an embodiment of an aspect of the present invention includes an upper section 11 comprising a main hollow cylindrical tube 12, having a lower cylindrical portion 14 of lesser diameter. The rock breaker tool 10 also includes a lower cylindrical section 13 comprising casing 16 having an upper cylindrical portion 18, which is configured for assembly to the lower cylindrical portion 14 of the upper section 11.

The main hollow cylindrical tube 12 includes an upper closed end 20, which is provided with a central access aperture 22. Within the main hollow cylindrical tube 12 is an upper, low-height cylindrical member 23 having a lower annular face 24 for contacting the upper end of compression spring 26. As well, the main hollow cylindrical tube 12 includes a lower, low-height cylindrical member 28 having an upper annular face 30, for contacting the lower end of compression spring 26. The lower cylinder 28 includes a downwardly-projecting barrel 32 which is internally threaded. Barrel 32 also includes an upwardly-extending cylinder rod 34. Longitudinally-extending compression spring 26 surrounds cylindrical rod 34, and has its upper end contacting face 24 of upper cylindrical member 23, and has its bottom end resting on the upper face 30 of lower cylindrical member 28. An inner, hollow, intermediate cylindrical filler 36 is secured within tube 12, to assist in guiding spring 26.

As seen generally in FIG. 1, and also more clearly in FIG. 2, FIG. 3, FIG. 4 and FIG. 5, the lower section 13 of the rock breaker tool 10 includes a concentrically-positioned, longitudinally-reciprocal plunger 38 within the cylindrical casing 16. Plunger 38 includes an upper, threaded cylindrical stub 40 which is threadedly secured to the internally threaded barrel portion 32 of lower cylinder 28.

Integral with the upper, threaded cylindrical threaded stub portion 40 is an upper, cylindrical portion 42. Integral with the upper cylindrical portion 42 is a diverging, preferably frusto-conical, portion 44. Integral with the diverging, preferably frusto-conical, portion 44, is a depending cylindrical rod 46, which terminates in a pointed, preferably conical, end 48.

The plunger 38 is surrounded by a plurality, in this embodiment, four, spools 50. Each spool 50 is a longitudinally-extending segment 52 of a hollow cylinder. Thus, each spool 50 includes an outer curved partial, cylindrical outer face 54, and an inner, curved, partial cylindrical inner face 56. The four outer faces 54 together constitute a broken cylindrical outer face 58, which is spaced from the inner cylindrical face 60 of the outer casing 16.

The upper end of each spool 50 includes an inner, converging, preferably partial frusto-conical, face 62, which is configured to be in slidable contact with diverging, preferably frusto-conical, portion 44 of plunger 38.

The lower end of each spool 50 includes an inner, diverging, preferably partial frusto-conical, face 64, and terminates is a thin depending, partially-cylindrical flange 66, which has a curved outer face 68 and a curved inner face 70.

Each spool 50 is provided with an attached, replaceable, hardened insert 90. Each such insert 90 is an elongated plate 92, having a flat, inner, longitudinally-extending end 94, and an outwardly-curved, outer, longitudinally-extending end 96. Each such hardened insert 90 is secured by its flat, inner, longitudinally-extending end 96 to its associated spool 50 by means of an upper screw 98 and a lower screw 100, which are inserted through respective bore holes 102, 104, with their outer ends flush with the outer face of the outer casing 16.

Figure 2:
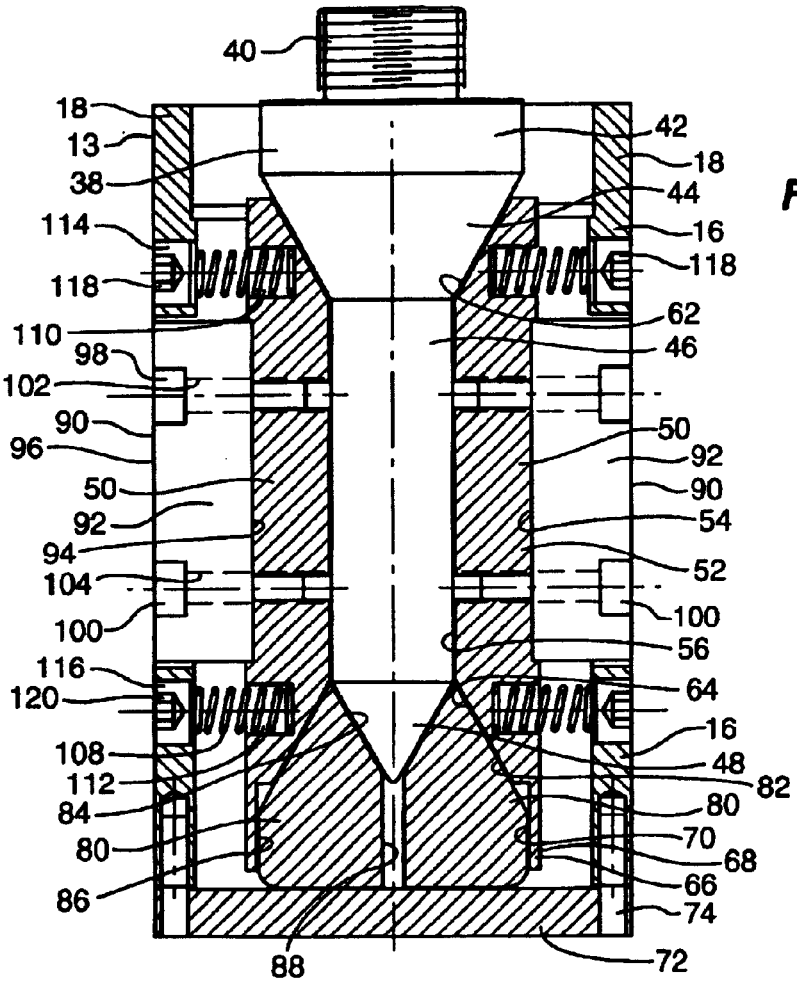
FIG. 2 is a longitudinal cross-section of the operative portion of the rock breaker tool shown in FIG. 1, in its retracted position.

Each unitary spool 50/hardened insert 90 is configured to be radially-outwardly extendible, while being biased to an inner orientation in its retracted position, shown in FIG. 1 and FIG. 2. Such unitary spool 50/hardened insert 90 is so mounted by means of an upper compression spring 106 and a lower compression spring 108, inset into respective wells 10, 112 and secured by respective cylindrical plugs 114, 116 held in place by respective screws 118, 120.

Figure 2A:
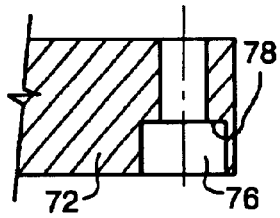
FIG. 2A is an inset of a modified portion of the rock breaker tool shown in FIG. 2.

The bottom of the outer casing 16 is closed by a bottom circular plate 72, which is secured to the outer casing 16 by a plurality of screws 74. As further shown in FIG. 2A, those screws 74 may include an enlarged head, 76, which is set into counterbore 78 in plate 72.

Resting on circular plate 72 is a plurality, in this embodiment four, equalizing spools 80. Each equalizing spool 80 includes an upper, outer, diverging, partial, preferably partial frusto-conical, surface 82, and an inner, converging, partial, preferably partial frusto-conical, surface, 84. Each equalizing spool 80 terminates in outer, partial cylindrical surface 86, and an inner partial cylindrical surface 88.

Surface 82 is configured to be in slidable contact with face 64 of spool 50, while surface 84 is configured to be in slidable contact with pointed end 48 of plunger 38.

Figure 3:
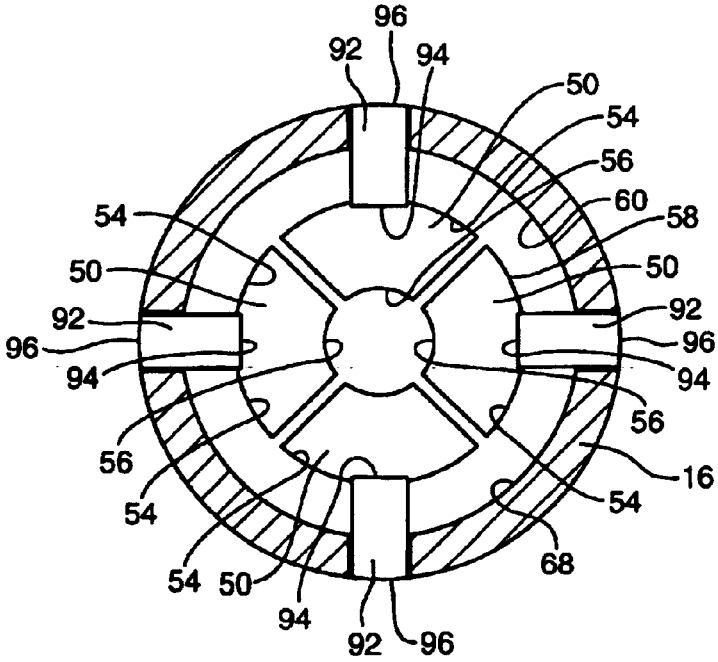
FIG. 3 is a transverse cross-section of the rock breaker tool shown in FIG. 2.
Figure 4:
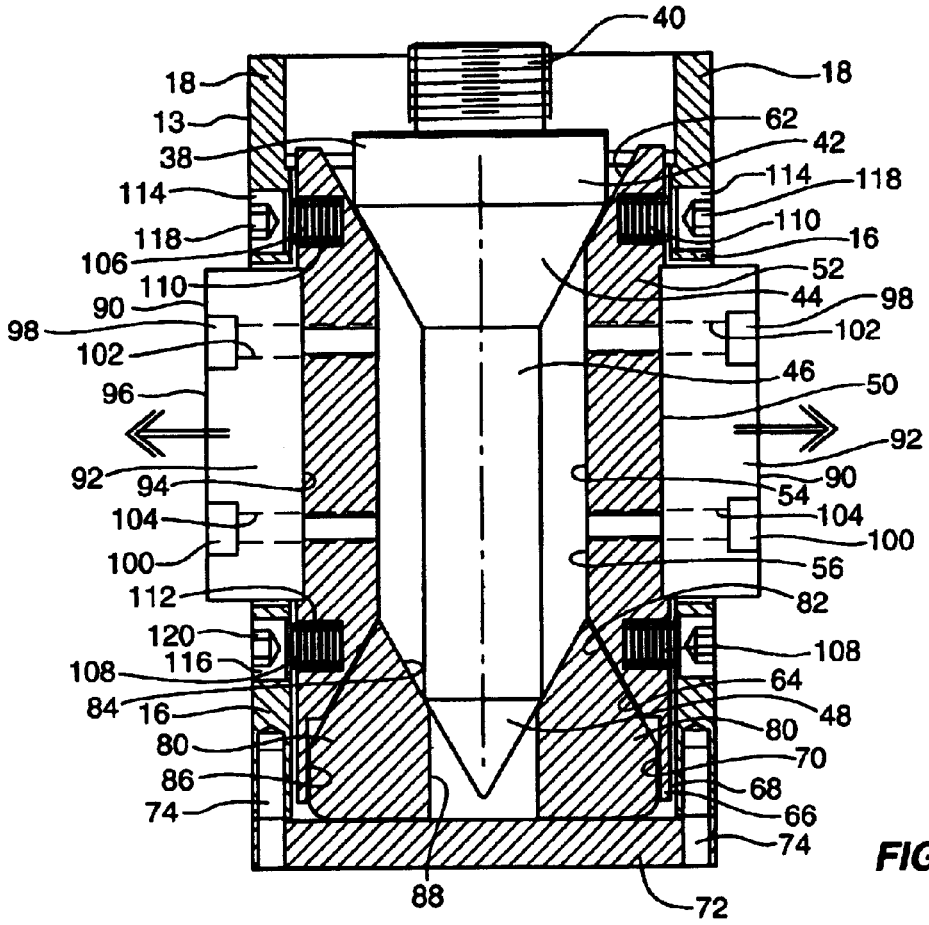
FIG. 4 is a longitudinal cross-section of the operative portion of the rock breaker tool shown in FIG. 1, in its extended position.
Figure 5:
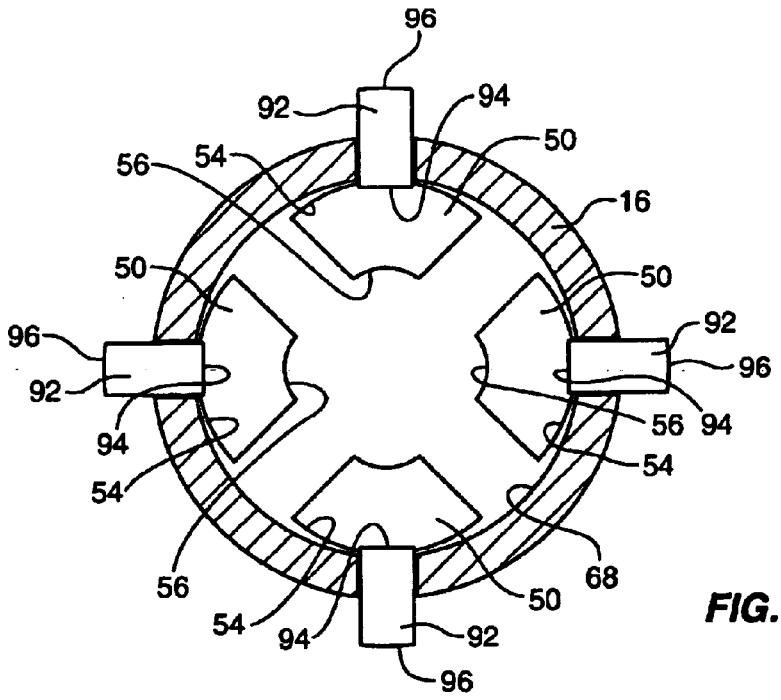
FIG. 5 is a transverse cross-section of the rock breaker tool shown in FIG. 4.

In operation, to go from the retraction orientation shown in FIG. 1, FIG. 2 and FIG. 3 to the extended orientation shown in FIG. 4 and FIG. 5, hydraulic fluid is pumped under pressure into main hollow cylindrical tube 12 through access aperture 22. Such hydraulic fluid applies pressure to the upper face 30 of combined lower cylinder 28/plunger 38, which causes plunger 36 to be depressed. This results in sliding action between the upper surface 44 and all the partial frusto-conical surfaces 62 to urge the four unitary spools 50/hardened inserts 90 radially-outwardly against the reaction of the compression springs 110. This results in the extended position of spools 50/hardened inserts 90 shown in FIG. 4 and FIG. 5.

When the hydraulic pressure within cylinder 12 is relieved, the unitary spools 50/hardened inserts 90 are urged back, by compression springs 106, 108, to the retracted position shown in FIG. 1, FIG. 2 and FIG. 3.

As noted above, the rock breaker tool of embodiments of the present invention uses a hydraulic cylinder to force a tapered plunger downwardly to spring a segmented tapered spool radially-outwardly. This spool is preferably made up of four segments with hardened inserts bolted onto each segment. These inserts are urged to extend radially-outwardly to exert force on the wall of the hole and are removable to facilitate replacement as they wear out, or as different shapes of inserts are required. As the tapers of plunger are pushed vertically downwardly onto the tapers of the segmented spool, the spool pieces move radially-outwardly. A second small segmented equalizing spool is preferably located at the bottom of the segmented tapered spool to assist in the spreading action and to ensure that the spools accurately move radially-outwardly. As the hydraulic cylinder retracts, the plunger of the rock breaker is urged to its "at rest" position, and the spools retract with the aid of two springs for each of the four segments.

The hydraulic cylinder which extends the plunger is preferably rated for a maximum 10,000 psi working pressure and is preferably powered by an electric or gasoline powered hydraulic pump (not shown), depending on the application for which the rock breaker is being used.

As noted above, the rock breaker tool of embodiments of the present invention can be set-up in a series of units spaced approximately 24 to 36 inches apart to bring an entire rock face down in quarries and/or can be used a single unit to break oversized rock or concrete into smaller pieces.

Figure 6:
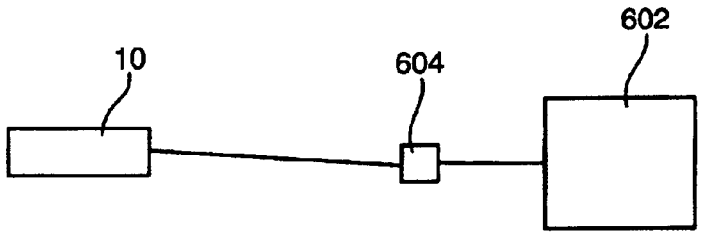
FIG. 6 is a schematic representation of the rock breaker tool of an embodiment of the present invention in its single rock breaker environment.

FIG. 6 shows the orientation of the rock breaker tool 10 as a single use. The rock breaker tool 10 is connected to a hydraulic pump 602 by way of a remote valve 604.

Figure 7:
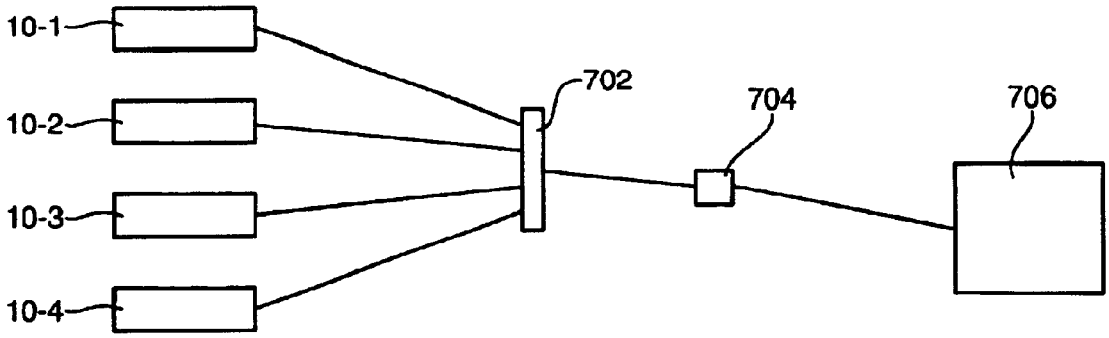
FIG. 7 is a schematic representation of the rock breaker tool of an embodiment of the present invention in its multiple rock breaker environment.

FIG. 7 shows the orientation as a series use. Multiple rock breakers 10-1, 10-2, 10-3, 104 are connected by way of manifold 702 and remote valve 704 to hydraulic pump 706.

The rock breaker tool of embodiments of the present invention was developed as an economical alternative to using explosives to break out rock from sides of rock quarries and breaking up rock into smaller manageable pieces to feed into rock crushers. The rock breaker tool of embodiments of the present invention also breaks up concrete in areas which explosives cannot be used.

The rock breaker tool embodiments of the present invention may be most advantageously used for stripping off large-size blocks of natural stone along a line of boreholes and for their subsequent splitting into blocks, for non-explosive driving of mining workings in rocks, or for demolishing foundations of old buildings and other structures. The rock splitter tool of embodiments of the present invention may also be used for working rock face deposits, for positive degassing of coal seams, for fracturing oil and gas formations, for investigations into stress-strain state of a rock mass under field conditions and as a powerful small-size drive for actuator members of presses, jacks, guillotines and other devices where considerable directional forces should be developed.

The rock breaker tool of embodiments of the present invention may also be used in different branches of industry, for example, in mining engineering and construction as follows:

for rock quarrying by way of breaking large monoliths along the line of blastholes off the rock mass followed by disintegration of monoliths into blocks;

for explosion-free driving of mine workings (tunnels, adits, etc.) when application of the blasting operations is not permissible;

for destruction of strong footings and foundations of old buildings;

for cleaning up slopes in construction of roads, water developments in mountainous terrain;

for weakening of a difficult-to-collapse roofs;

for forced degassing of coal seams and prevention of instantaneous outbursts by way of a positive relief of seams;

for fracturing of strata in oil and gas holes;

for studying of deformation and strength properties, and the stressed state of a rock mass of any strength in boreholes at a preset depth; and in the machine-building and metal-working industries as a universal drive of direction action for: powerful presses and press tools (providing both unilateral and all-round reduction); powerful jacks in those cases when there is no need for a substantial working travel; and guillotines used for cutting sheet steel, wire ropes, chains and other materials.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What is claimed is:

1. A device for breaking rocks comprising:

a hollow cylindrical chamber having a closed lower end, a closed upper end, an access aperture in said closed upper end and an outer circumferential surface;

a cylindrical plunger longitudinally-reciprocally disposed within the interior of said cylindrical chamber, said plunger being biased to a retracted position, the upper end of said plunger having an upper face and a converging portion below said upper face;

at least two spools disposed equally around the circumference of said cylindrical plunger, each said spool including a converging upper end which is configured to be in slidable contact with said converging portion of said cylindrical plunger;

at least two hardened inserts, each said hardened insert being secured to an outer face of an associated spool, each said hardened insert having a partial circumferential outer surface, which is coextensive with said outer circumferential surface of said cylindrical chamber, each said spool and its connected insert being biased to an inner retracted position; and means for applying a hydraulic pressure to said upper face of said cylindrical plunger; whereby said converging portion of said cylindrical plunger is urged to move downwardly, thereby urging said spools, together with said secured hardened inserts, radially-outwardly, so that said hardened inserts project radially outwardly from said outer surface of said hollow cylindrical chamber, and said cylindrical plunger including an upper threaded cylindrical portion, an adjacent, integral, cylindrical portion of greater diameter than said upper threaded cylindrical portion, an adjacent, integral frusto-conical portion, an adjacent, integral, depending cylindrical portion whose diameter is less than the diameter of said upper cylindrical portion, and a lowest integral adjacent conical point.

2. The device as claimed in claim 1, wherein said converging portion of said plunger is frusto-conical; and said converging upper end of said spool is likewise frusto-conical.

3. The device as claimed in claim 2, wherein there are four said spools, and four said hardened inserts.

4. The device as claimed in claim 1, wherein said cylindrical plunger is biased to its retracted portion by a longitudinally-positioned compression spring.

5. The device as claimed in claim 1, wherein each said spool is biased to said inner retracted position by means of radially-positioned compression springs.

6. The device as claimed in claim 5, wherein each said spool includes an upper said compression spring and a lower said compression spring.

7. The device as claimed in claim 1, wherein each said spool includes an outer, curved, longitudinally-extending, partial circumferential surface, and an inner curved longitudinally-extending, partial circumferential surface.

8. The device as claimed in claim 1, wherein each said spool includes an outer, curved, longitudinally-extending, partial circumferential surface, and an inner curved longitudinally-extending, partial circumferential surface, an upper converging frusto-conical surface between said outer curved longitudinally-extending, circumferential surface and said inner curved longitudinally-extending, partial circumferential surface, a lower diverging partially frusto-conical circumferential surface between said inner curved longitudinally-extending partial circumferential surface and said outer curved longitudinally-extending partial circumferential surface, and a terminal, partial circumferential flange.

9. A device for breaking rocks comprising:

a hollow cylindrical chamber having a closed lower end, a closed upper end, an access aperture in said closed upper end and an outer circumferential surface;

a cylindrical plunger longitudinally-reciprocally disposed within the interior of said cylindrical chamber, said plunger being biased to a retracted position, the upper end of said plunger having an upper face and a converging portion below said upper face;

at least two spools disposed equally around the circumference of said cylindrical plunger, each said spool including a converging upper end which is configured to be in slidable contact with said converging portion of said cylindrical plunger;

at least two hardened inserts, each said hardened insert being secured to an outer face of an associated spool, each said hardened insert having a partial circumferential outer surface, which is coextensive with said outer circumferential surface of said cylindrical chamber, each said spool and its connected insert being biased to an inner retracted position; and means for applying a hydraulic pressure to said upper face of said cylindrical plunger; whereby said converging portion of said cylindrical plunger is urged to move downwardly, thereby urging said spools, together with said secured hardened inserts, radially-outwardly, so that said hardened inserts project radially outwardly from said outer surface of said hollow cylindrical chamber, and at least two equalizers resting on the inner face of said closed lower end, and disposed equally around the circumference of said cylindrical plunger, each said equalizer including a diverging upper face, the lower end of each said at least two spools including a diverging face which is configured to be in slidable contact with the upper face of the associated equalizer.

10. The device as claimed in claim 9, wherein:

said diverging face of each said equalizer is partially frusto-conical; and said diverging face of each said spool is partially frusto-conical.

11. The device as claimed in claim 10, wherein there are four said spools and four said equalizers.

12. The device as claimed in claim 9, wherein each said equalizer includes an inner diverging face; and said cylindrical plunger includes a lower pointed conical end which is configured to be in slidable contact with said inner diverging faces of said equalizers.

13. The device as claimed in claim 12, wherein:

said inner diverging face is partially frusto-conical; and said cylindrical plunger has a conical end.

14. A device for breaking rocks comprising:

an upper hollow cylindrical chamber (A) connected to a lower hollow cylindrical chamber (B);

said upper hollow cylindrical chamber (A) comprising:

a closed upper end, said closed upper end including an access aperture;

an upper support ring and a lower support ring;

said lower support ring including an upstanding cylindrical rod and a lower, internally-threaded bushing; and a compression spring surrounding said upstanding cylindrical rod, an upper end of said compression spring abutting the lower surface of said upper support ring, a lower end of said compression spring resting on said lower support ring;

said lower cylindrical chamber (B) comprising:

an open upper end;

a closed lower end;

a concentrically-disposed cylindrical plunger, said cylindrical plunger including an upper threaded cylindrical portion threadedly secured to said lower internally-threaded bushing of said lower support ring, an adjacent, integral cylindrical portion of greater diameter than said upper threaded cylindrical portion, an adjacent, integral frusto-conical portion, an adjacent, integral, depending cylindrical portion whose diameter is less than the diameter of said adjacent upper cylindrical portion, and a lowest integral, adjacent conical point;

four spools disposed equally circumferentially around said cylindrical plunger, each said spool including an outer, curved, longitudinally-extending, partial circumferential surface, and an inner, curved, longitudinally-extending, partial circumferential surface, an upper, converging, partial frusto-conical surface between said outer, curved, longitudinally-extending, partial circumferential surface and said inner, curved, longitudinally-extending, partial circumferential surface, a lower, diverging partial frusto-conical surface between said inner, curved, longitudinally-extending, partial circumferential surface, and said outer, curved, longitudinally-extending, partial circumferential surface, and a terminal, partial circumferential flange, said partial frusto-conical upper end of each said spool being configured to be in slidable contact with said frusto-conical portion of said cylindrical plunger;

four hardened inserts, each said hardened insert being secured to an outer face of an associated spool, each said hardened insert including an elongated plate having an outer curved face and an inner flat face, said inner flat face being secured to said outer face of an associated spool by means of longitudinally-spaced-apart removable securing means;

each said spool and secured insert being biased to an inner retracted position by means of longitudinally-spaced-apart, compression springs, one end of each said compression spring being anchored within a radial well in an associated spool and being secured, by means of removable securing means, to the outer circumference of said lower hollow cylindrical chamber;

four equalizers disposed equally circumferentially around the circumference of said cylindrical plunger, and resting on the inner face of the lower closed end of said lower cylindrical chamber, each said equalizer including an inner, diverging, partial frusto-conical face which is configured to be in slidable contact with said lower conical point of said cylindrical plunger, an outer, diverging, partial frusto-conical face, and a lower, partially-cylindrical, portion, said outer, diverging, partial frusto-conical portion being configured to be in sliding contact with said lower, diverging, partial frusto-conical portion of an associated said spool, the outer partially-cylindrical portion of said equalizer being configured to be in slidable contact with the partial cylindrical flange of said spool; and means for applying hydraulic pressure to said upper face of said cylindrical plunger;

whereby said converging portion of said cylindrical plunger is urged to move downwardly, thereby urging said spools, together with said secured hardened inserts, radially-outwardly, so that said hardened inserts project radially-outwardly from said outer surface of said hollow cylindrical chamber.

15. The device as claimed in claim 14, wherein said upper hollow cylindrical chamber (A) is further connected to said lower hollow cylindrical chamber (B) by means of cooperating cylindrical portions of lesser diameter on one said hollow cylindrical chamber (A) or (B) and flange portions of greater diameter on the other said hollow cylindrical chamber, (B) or (A), respectively.

* * * * *